United States Patent [19]

Villarreal

[11] Patent Number: 4,869,167

[45] Date of Patent: Sep. 26, 1989

[54] VARIABLE SPEED OSCILLATING ROLLER

[75] Inventor: Jose A. Villarreal, Mesquite, Tex.

[73] Assignee: Royse Engineering, Inc., Dallas, Tex.

[21] Appl. No.: 203,470

[22] Filed: Jun. 7, 1988

[51] Int. Cl.[4] ..... B41F 31/14; B41L 27/16

[52] U.S. Cl. ..... 101/348; 101/DIG. 38

[58] Field of Search ..... 101/DIG. 14, 348, 349, 101/350, 351, 148, 352, 354, 355–358, 360, 361, 205, 206–209, DIG. 38; 29/116 R

[56] References Cited

U.S. PATENT DOCUMENTS 4,337,699 7/1982 Beisel ..... 101/DIG. 14

4,509,426 4/1985 Hardin ..... 101/DIG. 14

*Primary Examiner*—J. Reed Fisher

*Attorney, Agent, or Firm*—Richards, Harris, Medlock & Andrews

[57] ABSTRACT

A variable speed oscillating roller assembly (10) is provided for use on a press. The roller (12) in the assembly can be adjusted to oscillate at a desired speed by adjusting the frictional engagement between the roller and a first sleeve (18). If desired, the oscillation of the roller can be halted by securing a second sleeve (60) to the shaft (14).

3 Claims, 1 Drawing Sheet

VARIABLE SPEED OSCILLATING ROLLER

TECHNICAL FIELD

This invention relates to the printing industry, and in particular to printing rollers which must oscillate as they rotate to properly distribute printing ink and other fluids.

BACKGROUND OF THE INVENTION In the typical printing press, a series of rollers are employed to transfer a predetermined amount of printing ink, solvent or other printing fluid to the printing plate for transfer to the object being printed. It has been found that the distribution of ink and other printing fluids has been facilitated by providing for oscillation of rollers along their rotational axis during rotation of the cylinder.

Various mechanism have been developed to achieve this oscillation. However, these designs have been complex, expensive to manufacture and have permitted only one oscillation speed for a given rotational velocity of the roller. Further, there are operations where such oscillation is not desired. This requires the press operator to remove the oscillating roller and replace it with a non-oscillating roller. Further, oscillating roller designs in the past have tended to wear quickly, requiring frequent replacement. Therefor, a need yet exists in the industry for an oscillating roller which overcomes the disadvantages of this and other prior art devices.

SUMMARY OF THE INVENTION

In accordance with one aspect of the present invention, a variable speed oscillating roller assembly is provided for use in a press. The press includes a rotating driver roller to operate the roller assembly. The roller assembly includes a shaft mounted in the press and having an elongate center axis. A sleeve is rotatably mounted on the shaft and structure is provided for oscillating the sleeve on the shaft between first and second limits as the sleeve is rotated in a first rotational direction about the center axis of the shaft.

A roller is rotatably mounted on the sleeve for rotation about the center axis. The driver roller of the press contacts the roller and rotates the roller at a predetermined angular velocity about the center axis. Structure is provided for frictionally engaging the roller and sleeve which permits the engagement to vary to permit selection of a ratio of sleeve angular velocity to roller angular velocity between one and a lesser fraction to permit variation of the oscillation speed of the roller for a given predetermined roller angular velocity.

In accordance with another aspect of the present invention, a second sleeve is mounted on the shaft for movement along the center axis of the shaft, but held in a fixed angular relation to the shaft about the center axis. Structure is provided for rigidly connecting the second sleeve to the shaft to prevent oscillation of the roller.

In accordance with another aspect of the present invention, the structure for frictionally engaging the roller and sleeve includes an annular friction surface on the roller, an annular friction surface on the sleeve, and frictional material interposed between the friction surfaces. Structure is provided for moving the friction surfaces toward and away from each other to vary the frictional engagement therebetween through the frictional material.

BRIEF DESCRIPTION OF THE DRAWINGS

For a more complete understanding of the present invention, and the advantages thereof, reference is now made to the following description, taken in conjunction with the accompanying drawings, in which.

DETAILED DESCRIPTION

Figures 1, 2, 3, 3A, 4, 5:
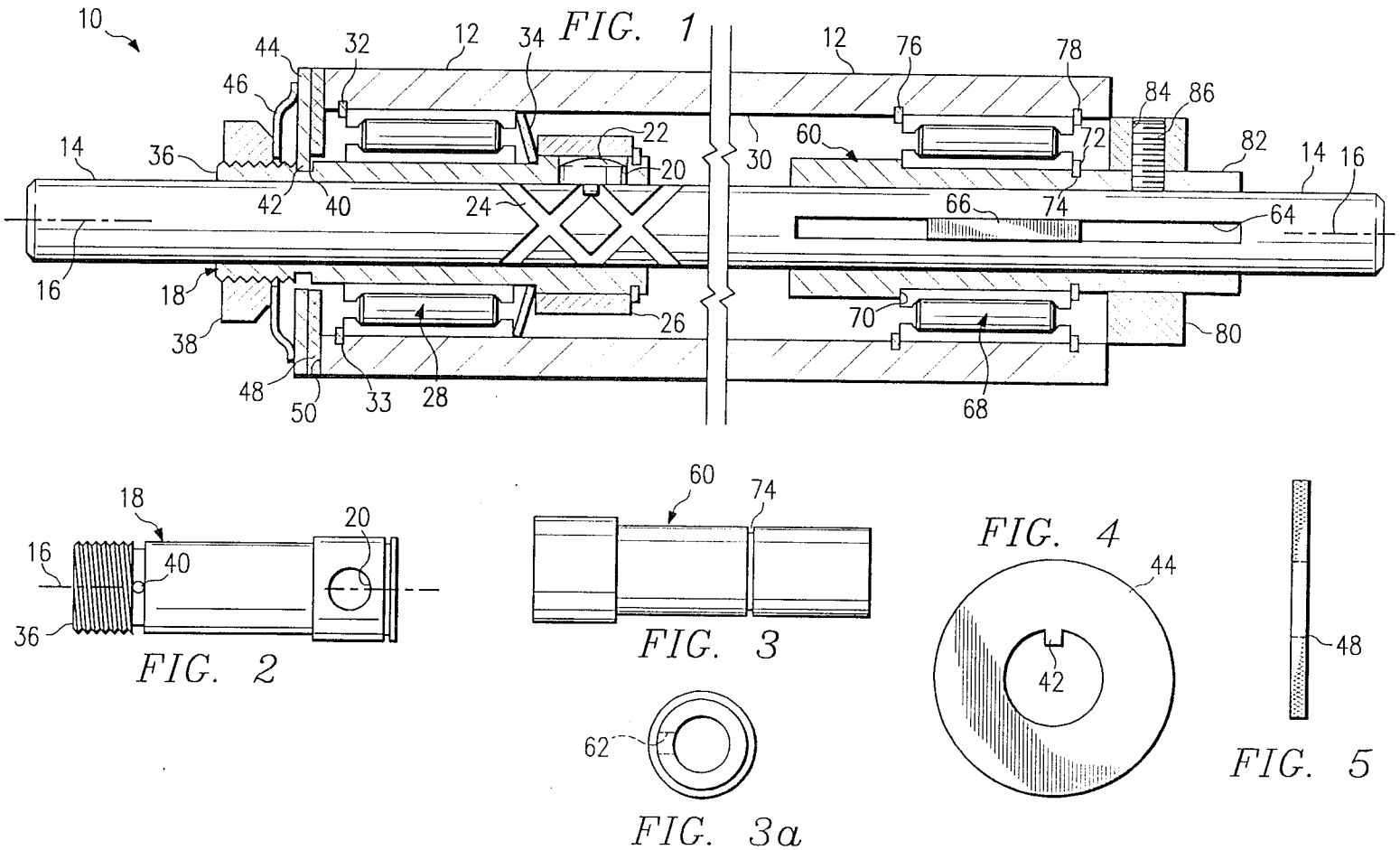
FIG. 1 is a partial cross sectional view of a variable speed oscillating roller assembly forming a first embodiment of the present invention.
FIG. 2 is a side view of a first sleeve used in the apparatus.
FIG. 3 is a side view of a second sleeve used in the apparatus.
FIG. 3A is an end view of the second sleeve.
FIG. 4 is an end view of a back u washer used in the apparatus.
FIG. 5 is a side view of a friction washer used in the apparatus.

With reference now to the drawings, and in particular to FIG. 1, a variable speed oscillating roller assembly 10 forming a first embodiment of the present invention is illustrated. The assembly includes a roller 12 which is employed in a printing press to distribute ink or other printing fluids evenly within the press. The roller 12 in the assembly described herein is in frictional contact with a driving roller (not shown) which driving roller is driven about its center axis at a predetermined rotational velocity and induces a corresponding rotation in roller 12 about axis 16. The roller 12 in turn, would contact another roller (not shown). In one possible application, ink or other fluid is transferred from the driving roller, to the roller 12, to the roller in contact therewith, and ultimately to the printing plate for transfer to the object being printed. However, assembly 10 can be also utilized in other applications within a press where oscillation is desirable. For example, it can be used as a blanket washer to clean the blanket roller.

As discussed previously, it is advantageous in certain applications to permit oscillation of a roller along its center axis in combination with rotation of the roller about its center axis. The desired speed of oscillation relative to the rotational velocity of the roller varies in different applications, or even different phases of a single application. Also, in some applications, an oscillating roller is not desirable. In the past, it has been necessary to substitute oscillating rollers having a predetermined ratio of oscillation speed to rotational velocity for a particular application, or to substitute a non-oscillating roller as needed. As will be described hereinafter, the assembly 10 permits selection for roller 12 of a ratio of oscillation speed relative to angular velocity, and also permits the roller 12 to rotate without oscillation.

As seen in FIG. 1, an idle shaft 14 is mounted in the press and has a center axis 16. In one suggested application, the shaft 14 is fixably mounted to the press and neither rotates about its center axis 16, nor oscillates along the axis. However, shaft 14 can also be mounted for movement relative the press in any manner desired.

A first sleeve 18 is mounted near one end of the shaft 14. Near the inner end of the sleeve is formed an aperture 20 which receives a key 22. A portion of the key 22 extends into an acme screw slot 24 formed in the outer surface of the shaft 14. A retaining collar 26 is fit around the inner end of the sleeve to hold the key in engagement with the slot 24. The middle of the sleeve 18 receives the inner race of a roller bearing 28. The outer race of bearing 28 contacts the inner surface 30 of roller 12. The outer race of the bearing 28 is confined in the roller by a snap ring 32 received in snap ring groove 33 in surface 30 which prevents movement of the bearing 28 to the left in FIG. 1 along the center axis 16 relative to the roller. However, the first sleeve permits limited movement of the inner race of the bearing 28 relative to the sleeve along the center axis with a spring washer 34 acting between the outer race and first sleeve as shown in FIG. 1.

The outer end 36 of first sleeve 18 is threaded to receive a nut 38. Also, outer end 36 has a notch 40 formed inward of the threads to receive a mating key 42 on a back up washer 44. As seen in FIG. 1, the nut 38 holds a spring washer 46, back up washer 44, and a friction washer 48, made of frictional material, against the annular end 50 of the roller 12.

A second sleeve 60 is mounted on shaft 14 near the end opposite the first sleeve. The sleeve 60 has a linear slot 62 which faces a mating linear slot 64 in the shaft, permitting a square key 66 extending into each slot to permit limited movement of the sleeve 60 along the center relative to the shaft. However, the key prevents rotation of the sleeve about the center axis relative to the shaft.

The inner race of a roller bearing 68 is received near the middle of the sleeve and secured there between an annular shoulder 70 on the collar and a snap ring 72 received in snap ring groove 74 in the second sleeve. The outer race of the roller bearing 68 is received on the inner surface 30 of the roller 12 and held thereby snap rings 76 and 78.

An annular collar 80 is secured at the outer end 82 of the sleeve 60 and is provided with a threaded aperture 84 receiving a lock screw 86. By tightening the screw against the outer surface of the shaft 14, the second sleeve 60 can be locked to shaft 14 and the roller 12 will be prevented from oscillating, but can rotate freely about sleeves 18 and 60. The roller assembly 10 provides significant flexibility in use. If oscillation is desired, the roller 12 can be adjusted to oscillate between first and second limits, determined by the extent of the acme screw 24, by adjusting the nut 38 &o vary the ratio of angular velocity between the first sleeve 18 and the roller 12 about the center axis. If the nut is tightened sufficiently to lock the first sleeve to the roller 12 for joint rotation at the same angular velocity, the oscillation speed will be maximum for a given roller rotational velocity. As the nut is loosened, the frictional engagement between the roller 12 and first sleeve 18 is reduced, and the first sleeve will begin to slip relative to the roller, causing the ratio of angular velocity of the first sleeve 18 about the S center axis relative to the rotational velocity of the roller 12 about the center axis to fall below one. The direct engagement of key 22 with acme screw slot 24 sets the ratio of movement of the first sleeve along the center axis with respect to relative rotation of the first sleeve about the shaft. However, the degree of frictional engagement between the roller 12 and the first sleeve 18 allows the rotational velocity of the first sleeve to be somewhat less than the rotational velocity of the roller 12, thus reducing the effective oscillation speed of the roller 12 for a given roller angular velocity.

If oscillation is undesirable, the nut 38 can be backed off to minimize the frictional engagement between the roller 12 and the first sleeve 18, and the screw 86 tightened against the shaft 14 to prevent oscillation of the roller 12. Thus, the roller assembly can be used as a simple rotating roller, if desired.

The present invention also has the advantage of minimizing wear on the internal components of the assembly as the oscillating forces are not transferred totally through the slot 24 and key 22, but as well through the frictionally engaged elements. Further, if the key 22 were to shear, or jam within the acme slot 24, the roller 12 would still be permitted to rotate through the frictional connection with the first sleeve. This provides a significant improvement over prior art designs where failure of internal components can cause the oscillating roller to stop, creating a potential for damage of the press.

Although a single embodiment of the invention has been illustrated in the accompanying drawings, and described in the foregoing Detailed Description, it will be understood that the invention is not limited to the embodiment disclosed, but is capable of numerous rearrangements, modifications and substitutions of parts and elements without departing from the scope and spirit of the invention.

I claim:

1. A variable speed oscillating roller assembly for a press, the press having a rotating driving roller, comprising:

a shaft mounted in the press and having an elongate center axis;

a first sleeve rotatably mounted on the shaft; means for oscillating the first sleeve on the shaft between first and second limits along the center axis as the sleeve rotates in a first rotational direction about the center axis;

a roller mounted on the first sleeve for rotation about the center axis, the driving roller of the press contacting the roller to rotate the roller about the center axis:

means for frictionally engaging the roller and first sleeve so that the roller and first sleeve oscillate together along the center axis, the engagement being varied to allow slippage between the roller and sleeve to vary the speed of oscillation of the roller for a predetermined roller angular velocity.

2. The roller assembly of claim 1 further having a second sleeve mounted on the shaft for movement along the center axis of the shaft, but held in a fixed angular relation to the shaft about the center axis;

means to rotatably mount the roller on the second sleeve for rotation about the center axis, the second sleeve and roller being fixed together for joint motion along the center axis; and means to rigidly connect the second sleeve to the shaft to prevent oscillation of the roller.

3. The roller assembly of claim 1 wherein said means for frictionally engaging the roller and sleeve include an annular friction surface on the roller, a washer having an annular friction surface facing the annular friction surface on the roller and mounted on the first sleeve for limited motion along the center axis relative to the first sleeve, a friction washer positioned between the facing friction surfaces on the roller and washer and means for urging the washer toward the roller to frictionally engage the washer and roller.

* * * * *